US010960960B2

(12) United States Patent
Cagnin et al.

(10) Patent No.: US 10,960,960 B2
(45) Date of Patent: Mar. 30, 2021

(54) STORAGE OF LIFERAFTS

(71) Applicant: SURVITEC GROUP LIMITED, Birkenhead (GB)

(72) Inventors: Philippe Cagnin, Fleac (FR); Tommy Scott, Antrim (GB); Pascal Michaud, Chevanceaux (FR)

(73) Assignee: SURVITEC GROUP LIMITED, Birkenhead (GB)

( * ) Notice: Subject to any disclaimer, the term of this patent is extended or adjusted under 35 U.S.C. 154(b) by 0 days.

(21) Appl. No.: 16/466,909

(22) PCT Filed: Nov. 13, 2017

(86) PCT No.: PCT/EP2017/079044
§ 371 (c)(1),
(2) Date: Jun. 5, 2019

(87) PCT Pub. No.: WO2018/104005
PCT Pub. Date: Jun. 14, 2018

(65) Prior Publication Data

US 2019/0329852 A1 Oct. 31, 2019

(30) Foreign Application Priority Data

Dec. 7, 2016 (GB) ..... 1620790

(51) Int. Cl.
*B63C 9/23* (2006.01)
*H05B 3/34* (2006.01)
*B63C 9/04* (2006.01)

(52) U.S. Cl.
CPC ..... *B63C 9/23* (2013.01); *H05B 3/34* (2013.01); *B63C 9/04* (2013.01); *B63C 2009/042* (2013.01)

(58) Field of Classification Search
CPC ..... B63C 9/23; B63C 9/04; B63C 2009/042; H05B 3/34; H05B 3/24
See application file for complete search history.

(56) References Cited

U.S. PATENT DOCUMENTS 2,666,840 A 1/1954 Poirier
4,560,356 A * 12/1985 Burr ..... B63C 9/08 222/5
6,229,123 B1 * 5/2001 Kochman ..... A41D 13/0051 219/529
2012/0061265 A1 * 3/2012 Jorgensen ..... B63C 9/22 206/223

(Continued)

FOREIGN PATENT DOCUMENTS

EP 1877303 8/2010
EP 2185405 1/2018

(Continued)

OTHER PUBLICATIONS

UK Search Report dated Jun. 1, 2017, in related UK Application No. GB1620790.4, (4 pages).

(Continued)

*Primary Examiner* — Stephen P Avila
(74) *Attorney, Agent, or Firm* — Maschoff Brennan

(57) ABSTRACT

A liferaft system comprises a container for storing a liferaft, and at least one sheet of material for fitting over an exterior surface of the liferaft container and configured to heat an interior volume of the liferaft container.

18 Claims, 7 Drawing Sheets

(56) References Cited

U.S. PATENT DOCUMENTS

2016/0060871 A1* 3/2016 Kulkarni ..... E04D 13/103
219/213

FOREIGN PATENT DOCUMENTS

| | | |
|---|---|---|
| GB | 1267658 | 3/1972 |
| KR | 20100069882 | 6/2010 |
| WO | 2000/019773 | 9/1999 |
| WO | 2006/099736 | 9/2006 |
| WO | 2009/030234 | 3/2009 |

OTHER PUBLICATIONS

International Search Report and Written Opinion dated Jan. 26, 2018, in related PCT Application No. PCT/EP2017/079044.

* cited by examiner

STORAGE OF LIFERAFTS

TECHNICAL FIELD

The present invention relates to a liferaft container heater, and to a liferaft system comprising a container for storing a liferaft and a heater.

BACKGROUND TO THE INVENTION

Various types of liferafts are known that are stored in a liferaft container. The container may provide protection for the liferaft and allow for ease of handling, and also facilitate deployment of the liferaft.

FIGS. 1A-D show a known rigid container for storing an inflatable liferaft. The container, indicated generally at 10, is of generally cylindrical form. The container 10 comprises an upper half shell 12 and a lower half shell 14, each of which is generally semi-cylindrical. The container 10 may be mounted to the deck 15 of a ship or other vessel by a cradle 16, and may be fixed in place with respect of the cradle 16 (and therefore also to the ship or vessel) by straps 18.

An inflatable liferaft 11 (indicated by dashed lines in FIGS. 1C and 1D) is stored in the container 10 in its deflated state. When deployment of the liferaft is required, the straps 18 are released by deployment apparatus, and the upper half shell 12 and the lower half shell 14 are moved apart, allowing the liferaft 11 to be fully inflated. The inflation of the liferaft 11 may push the upper half shell 12 and the lower half shell 14 apart.

The liferaft container 10 of FIGS. 1A-D is a rigid container. An alternative known type of container is shown generally at 20 in FIG. 2. The container 20 is formed of flexible material. Such a container is often referred to as a valise. Portions of the container 20 are moved apart from one another in order to allow full inflation of the liferaft 11. For the flexible container of FIG. 2, a zipper or breakable seal 22 allows the container 20 to be opened and for the liferaft to be deployed. The inflation of the liferaft 11 may itself push the portions apart.

Although such known containers do provide some protection from damage to liferafts by rain, sea water and wind, the temperature of the liferafts in the containers will generally be the same as the ambient temperature on the deck 15 of the vessel.

Inflatable liferafts are inflated with an inflation gas, such carbon dioxide from a gas cylinder (which may be stored in the container). As the carbon dioxide is vented from the gas cylinder into the liferaft, the gas expands and cools.

Vessels may operate in a variety of climates and it is important that the liferafts can be deployed at any ambient temperature that is likely to be encountered. For example, the liferafts stored on the decks of vessels operating in Antarctica may be subject to the ambient temperature of an average of −35° C.

The cooling effect of the inflation gas is a particular problem when a liferaft is inflated in a low temperature environment. The expansion and cooling of the carbon dioxide can result in the formation of carbon dioxide "snow", reducing the temperature even further and possibly clogging the gas outlet.

Inflating liferafts at very low temperatures can be problematic as the fabric forming the inflatable chambers may freeze which will delay or prevent correct inflation of the liferaft, and can have serious consequences in an emergency situation.

Liferaft containers on vessels operating in low temperature environments may also accumulate a layer of ice. The layer of ice, if sufficiently thick, can stop the container from opening.

Embodiments of the present invention seek to provide improved performance for liferafts used in cold conditions.

SUMMARY OF THE INVENTION

According to a first aspect of the present invention, there is provided a liferaft container heater comprising at least one sheet of material configured for fitting over an exterior surface of the liferaft container and configured to heat an interior volume of the liferaft container.

According to a second aspect of the present invention, there is provided a liferaft system comprising a container configured for storing a liferaft, and at least one sheet of material configured for fitting over an exterior surface of the liferaft container and configured to heat an interior volume of the liferaft container.

In the embodiment to be described the container includes first and second relatively movable portions that are configured to allow the container to open to facilitate removal of the contents of the container (the liferaft). The opening may be performed by the moving apart of two rigid moveable portions, or by the flexing of one or more flexible portions (such as when the container is a valise).

The sheet of material may comprise first and second regions located respectively over the first and second relatively movable portions of the liferaft container. Such an arrangement may allow the first and second regions to move with the first and second relatively moveable portions so as not to obstruct the removal of the contents of the container.

Advantageously, the first region meets the second region at a position that is aligned with a position where the first and second relatively moveable portions meet. This allows an opening of the container to be aligned with an opening of the sheet of material.

To allow the opening of the sheet of material, the first region may be attached to the second region by a releasable coupling—preferably an automatically releasable coupling that may be activated, for example, by pressure applied from inside the container by inflation of the liferaft.

The releasable coupling may comprise a burst open zipper, a hook-and-looped fastener (such as Velcro®), press studs or the like. Alternatively or additionally the releaseable coupling may be a portion of the sheet of material with a line of weakness. The line of weakness may comprise a perforated area of the material.

The sheet of material may extend around the liferaft container such that the first region meets the second region at opposite ends of the first region. Thus, the sheet of material may surround the liferaft container. A one of the releasable couplings may be positioned at each of the opposite ends of the first region. With such an arrangement there will be two releasable couplings in the sheet of material. In the embodiment to be described in detail, a releaseable coupling is positioned at one of the ends of the first region, and the other end of the first region is joined continuously to the second region (for example, first and second regions may be integrally connected at the other end).

The liferaft system may include liferaft deployment apparatus. Such deployment apparatus may allow the controlled release of the liferaft when required. Advantageously, the sheet of material may be operable to heat the deployment apparatus. The sheet of material may optionally include a flap extending from the sheet of material for covering the liferaft deployment apparatus. This may protect the liferaft deployment apparatus from the elements and extreme temperatures in a simple and cost effective manner. A flap may extend from each of the first and second regions, with one flap extending over the outside of the deployment apparatus and the other flap extending to the inside of the deployment apparatus.

Means may be provided for heating the flap. Alternatively, or additionally, the flap may be thermally insulated.

In the embodiment the sheet of material includes an electrically powered heater. This provides a convenient way of providing heating of the liferaft, and can be powered by the power supply of the vessel with which the liferaft system is associated.

The liferaft container may have many different forms. In one example, the liferaft container is generally rigid and is generally cylindrical, with the first and second relatively moveable portions being semi-cylindrical.

The liferaft system may include generally planar end walls for fitting over the ends of the generally cylindrical liferaft container. The sheet of material may extend over the curved surface of the generally cylindrical liferaft container and may be connected to the generally planar end walls.

A rigid container may have a different shape, such as a cuboid shape. The liferaft container may also be formed of generally flexible material (e.g. of the "valise" type).

In addition to heating the interior volume of the liferaft container, the sheet of material may also be configured to heat an exterior surface thereof. This exterior surface heating may advantageously prevent the build-up of excessive ice that may be detrimental to the operation of the liferaft system.

The embodiment is particularly advantageous when the liferaft is an inflatable liferaft. The application of heat to the liferaft container allows the inflatable liferaft to be maintained at a temperature that allows it to be inflated rapidly and effectively even when the external ambient temperature is below a level at which the material of the liferaft would normally function correctly.

BRIEF DESCRIPTION OF THE DRAWINGS

For a better understanding of the present invention an embodiment will now be described by way of example, with reference to the accompanying drawings, in which.

In the drawings, like elements are generally designated with the same reference sign.

DETAILED DESCRIPTION OF EMBODIMENT OF THE INVENTION

Embodiments of the present invention will be described with reference to FIGS. 3 to 9 of the accompanying drawings.

Figure 1A:
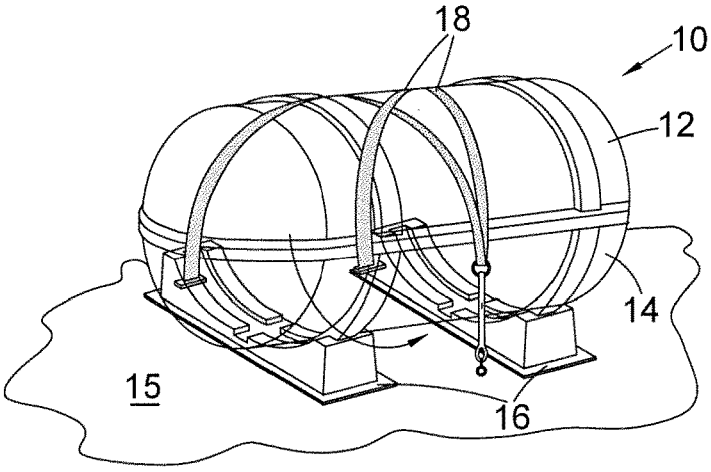
FIG. 1A shows a perspective view of a known liferaft container and mounting system.
Figure 1B:
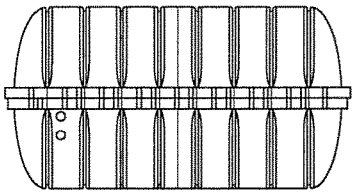
FIG. 1B shows a front elevation of the liferaft container of FIG. 1A.
Figure 1C:
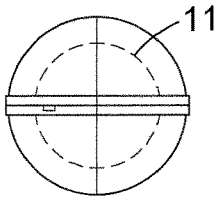
FIG. 1C shows a left side elevation of the liferaft container of FIG. 1A.
Figure 1D:
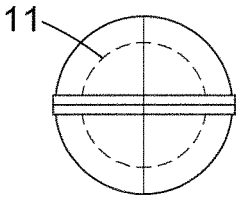
FIG. 1D PRIOR ART
FIG. 1D shows a right side elevation of the liferaft container of FIG. 1A.

According to the embodiment a liferaft system comprises a container 10 that stores an inflatable liferaft 11 (indicated by dashed lines in FIGS. 1C, 1D and 4A) as described above, and, in addition, a warming jacket 13 for allowing the inflatable liferaft to be heated.

Figure 2:
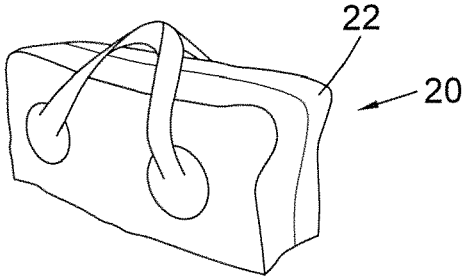
FIG. 2 PRIOR ART
FIG. 2 shows a perspective view of a known flexible liferaft container or valise.
Figure 3A:
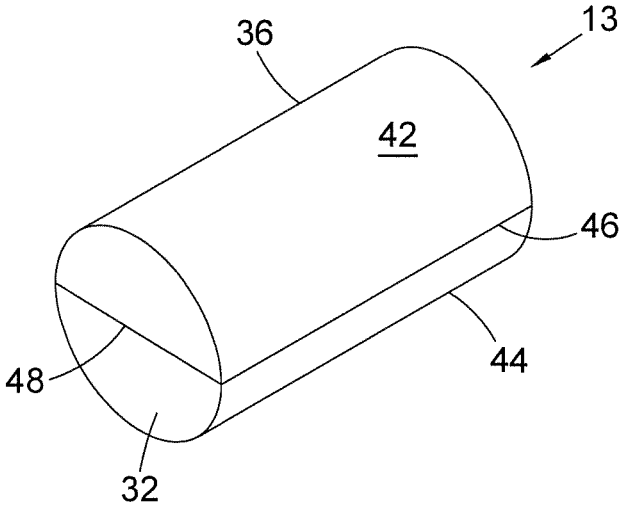
FIG. 3A shows front perspective view of a warming jacket in accordance with an embodiment of the present invention.
Figure 3B:
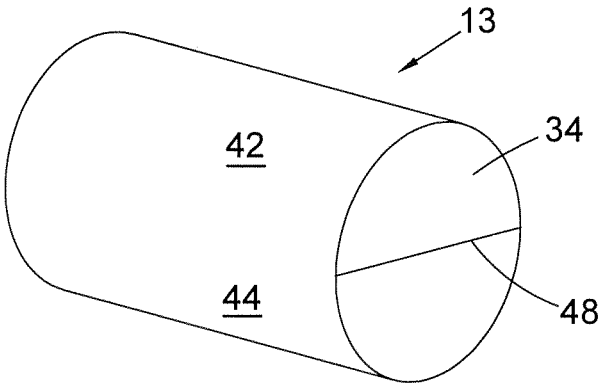
FIG. 3B shows a rear perspective view of the warming jacket of FIG. 3A.

FIGS. 3 to 9 show the warming jacket 13 for fitting over the exterior surface of a liferaft container 10. In the Figures the container 10 is of the type shown in FIGS. 1A-D, although the invention is also applicable to containers of other forms, such as containers that are not cylindrical (e.g. cuboid) or that are flexible (e.g. as shown in FIG. 2) rather than rigid.

Figure 7:
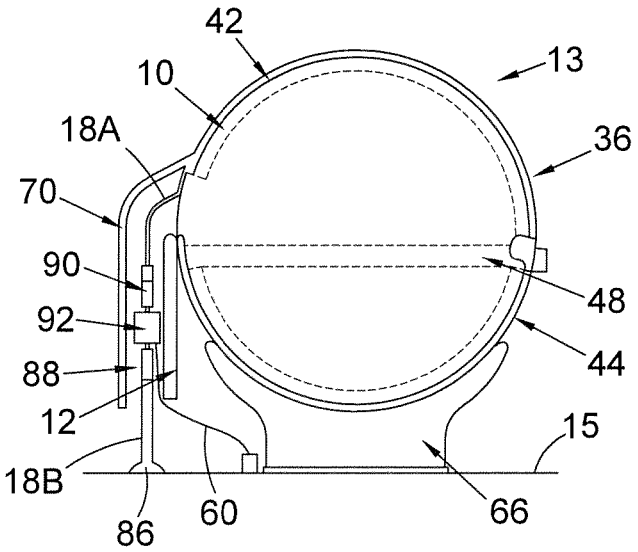
FIG. 7 shows a cross-sectional view taken along line X-X of the liferaft system of FIG. 6.

The container 10 of FIGS. 1A-D is circular in transverse cross-section. The upper half shell 12 is semi-circular in transverse cross-section and the lower half shell 14 is also semi-circular in transverse cross-section. The edges of the upper half shell 12 and the edges of the lower half shell 14 are provided with cooperating flanges that seal together to close the container 10. The container 10 may be lined with a protective foam. The container 10 is shown in FIG. 7 and by dashed lines in FIG. 4A.

The liferaft stored in the container 10 may be packed in a sealed plastics or foil bag that is substantially water impermeable. The bag may contain the deflated liferaft and an inflation system including gas cylinders and control valves.

The bag may include a visual humidity indicator, which may be positioned so that it projects through an aperture in the container 10 such that it is visible from outside the container. Alternatively, an electrical humidity sensor may be provided in the bag and that has external terminals from which a humidity level reading may be taken. The humidity indicator/sensor indicates whether the integrity of the bag has been compromised by humidity entering the bag.

Other items may also be stored in the container, such as food and medical supplies.

The upper half shell 12 and the lower half shell 14 may be connected to one another along one side by a hinge-type arrangement, which could be implemented by a strip of connecting material glued to and thus connecting the edges of the two half shells together, to enable the half shells to pivot relatively to one another about the joining edge to allow the half shells 12, 14 to open and facilitate deployment of the liferaft. Alternatively, the half shells 12, 14 may not be attached to one another, and so may separate from one another when the liferaft is deployed.

The warming jacket 13 is shaped for fitting over the liferaft container 10. The warming jacket 13 has a shape that corresponds to the shape of the liferaft container 10. As the container 10 in the embodiment to be described is cylindrical in shape, the warming jacket 13 is also cylindrical in shape. If the container had a different shape, the warming jacket is preferably shaped accordingly.

The warming jacket 13 includes a first planar end 32 and a second, opposite planar end 34, each of which have a form of a disc. The warming jacket 13 also includes a sheet of material 36 that extends around and between each of the walls 32 and 34, these elements together defining a cylindrical interior volume in which a container, such as the container 10 of FIGS. 1A-D can be accommodated.

The sheet of material 36 has a first region 42 that fits over the upper half shell 12 and a second region 44 that fits over the lower half shell 14. The first region 42 may be connected to the second region 44 continuously at one side of the sheet (so that the regions 42 and 44 are integrally connected at this side). At the opposite side of the sheet the first region 42 and the second region 44 may be attached to one another by a releasable coupling 46.

The releasable coupling 46 may have various forms. Preferably, the releasable coupling 46 operates automatically. For example, when the liferaft 11 inflates inside the container 10, this pushes apart the upper half shell 12 and the lower half shell 13 to open the container 10. The upper half shell 12 and the lower half shell 14 push against the first region 42 and second region 44 of the sheet of material 36, which causes the releasable coupling 46 to open automatically as a result of the pressure applied.

The releasable coupling 46 may be formed by a burst-open zip, by hook-and-loop type fasteners (such as Velcro®), press studs or the like. The releasable coupling 46 may alternatively be a line of weakness formed in the sheet of material 36, so that the sheet of material breaks along this line of weakness when pressure is applied. The line of weakness may comprise a perforated area of the sheet of material 36.

Each of the end walls 32 and 34 may include a releasable coupling 48 that is aligned with the releasable coupling 44 of the sheet of material 36 so as to form a releasable coupling line that extends along the length of the sheet of material 36 and across each of the end walls 32 and 34. The end wall releasable couplings 48 are preferably automatic in a similar manner to the releasable coupling 46 for the sheet of material and may be formed in any of the ways mentioned above in relation to the releasable coupling 46 for the sheet of material.

Figure 4A:
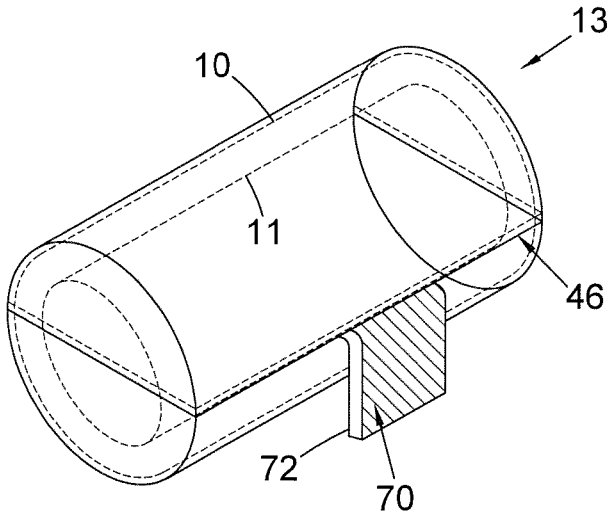
FIG. 4A shows a front perspective view of a warming jacket including outer and inner flaps, and shows components contained within the warming jacket by dashed lines.
Figure 4B:
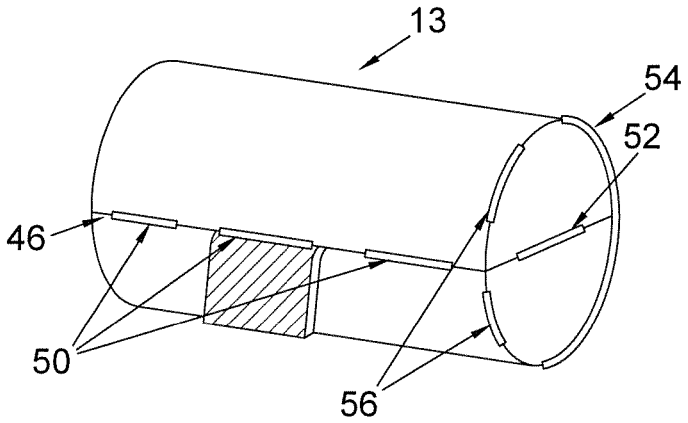
FIG. 4B shows a front perspective view of a warming jacket including outer and inner flaps, and releasable couplings between first and second regions of the warming jacket.

An example of the layout and form of the releasable couplings is shown in FIG. 4B. In this example, the releasable coupling 46 for the sheet of material 36 is formed by three spaced apart Velcro fastening regions 50. The releasable coupling 48 of each of the end walls 32 and 34 is formed by a single Velcro fastening region 52.

The end walls 32 and 34 may be permanently attached to the sheet of material 36 around part of their circumferences. The end walls 32 and 34 may be fully or partially releasably coupled to the sheet of material 36. The releasable coupling may have one of the forms described above. In FIG. 4B the end walls 32 and 34 are permanently attached to the sheet of material 36 around approximately half of their circumference by sewn regions 54, and are releasably coupled to the sheet of material 36 for the rest of the circumference by two Velcro fastening regions 56.

Figure 8A:
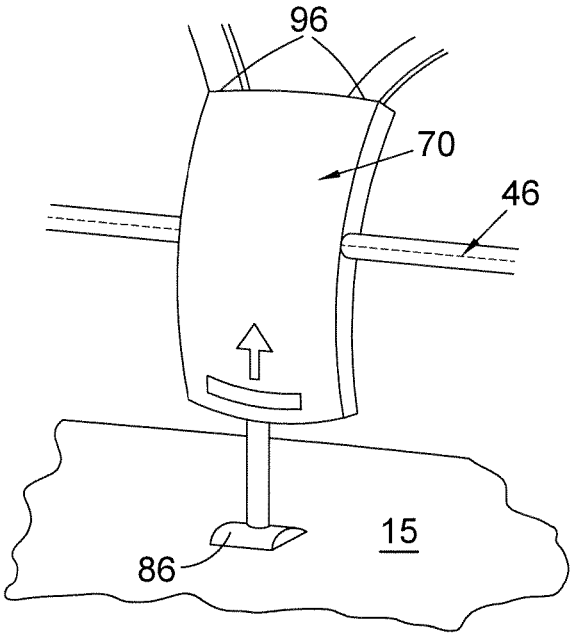
FIG. 8A shows a partial enlarged view of the liferaft system of FIG. 6 with the outer flap closed.
Figure 8B:
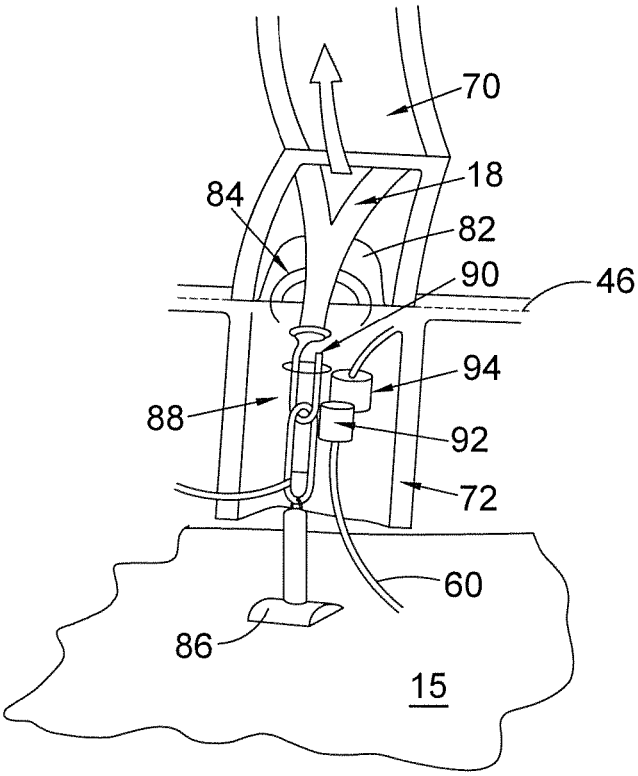
FIG. 8B shows a partial enlarged view of the liferaft system of FIG. 6 with the outer flap open.

The sheet of material 36 is supplied with electric current by electricity supply cable 60 (see FIG. 8B). This supplies power to electric heaters forming part of the sheet of material 36 (described in detail later in relation to FIG. 9). If the first region 42 and the second region 44 are not integrally connected to one another, each may need a separate electricity feed from the cable 60.

The end walls 32 and 34 may incorporate heat insulating material such as foam insulation. Alternatively, the end walls 32 and 34 may be electrically heated (and may be fed by the electricity supply cable 60).

FIG. 8B shows liferaft deployment apparatus 88, which is also shown in FIG. 7. The liferaft deployment apparatus 88 allows the liferaft 11 to be deployed when required by releasing the liferaft container 10, and will be described in more detail later.

Figure 5:
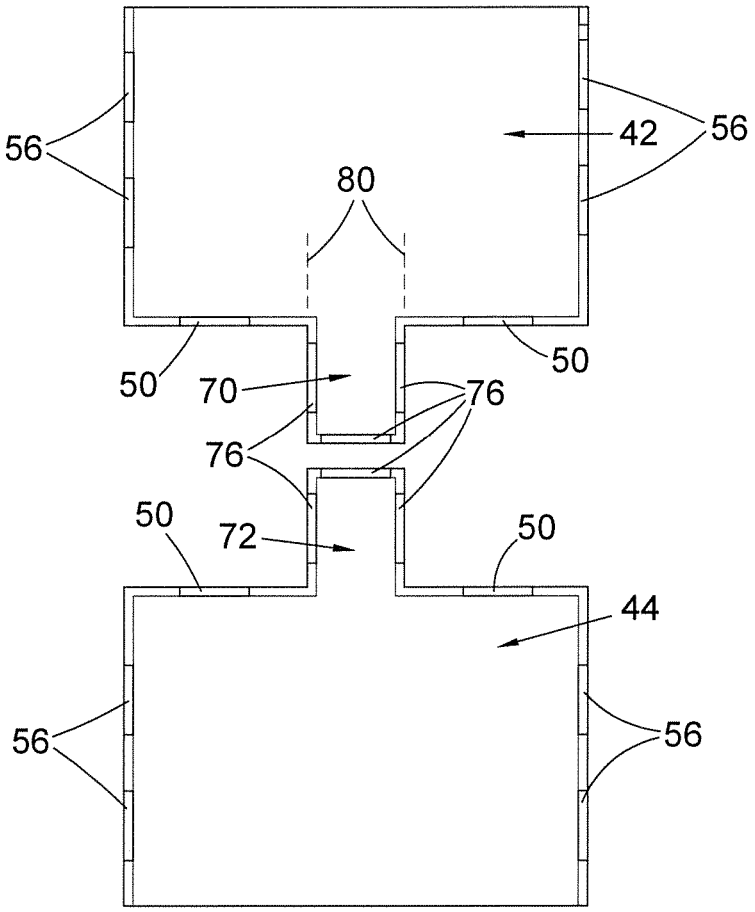
FIG. 5 shows an overhead view of a first region and a second region of a sheet of material forming part of the warming jacket.

The sheet of material 36 may include at least one flap 70 extending therefrom. Preferably, the first region 42 includes the flap 70 and the second region 44 includes a further flap 72. The flaps 70, 72 preferably extend from a central region of the sheet of material 36 between the end walls 32 and 34, and the flaps are arranged so that they are generally aligned. The flaps 70 and 72 may be formed integrally with their respective regions 42 and 44 of the sheet of material 36, as shown in FIG. 5. As shown in FIG. 5, each of the flaps 70 and 72 may be provided with one or more (three in the example shown) Velcro strips 76 that allow the flaps 70 and 72 to be releasably coupled together.

The heater of the region 42 may extend into the flaps 70. Likewise, the heat of the region 44 may extend into the flaps 72. The flaps at 70 and 72 may alternatively, or additionally, be provided with heat insulation, such as foam insulation.

Although Velcro is described in the example, it should be understood that the Velcro strips 76 could be replaced with some other releasable coupling, for example of the types described above in relation to the releasable coupling 46 for the sheet of material.

Although, as shown in FIG. 5, the flap 70 extending from the first region 42 is shown as a rectangular extension from the first region 42, the flap may extend into the first region 42 as indicated by dashed lines 80 so that, on opening the flap 70 a portion of the upper half shell 12 is exposed, as shown in FIG. 8B. This portion of the upper shell 12 may include an aperture 82 through which a davit launch ring 84, inside the container 10, is accessible for attachment to a davit launch apparatus to allow the liferaft assembly to be launched from the vessel by the davit.

Figure 6:
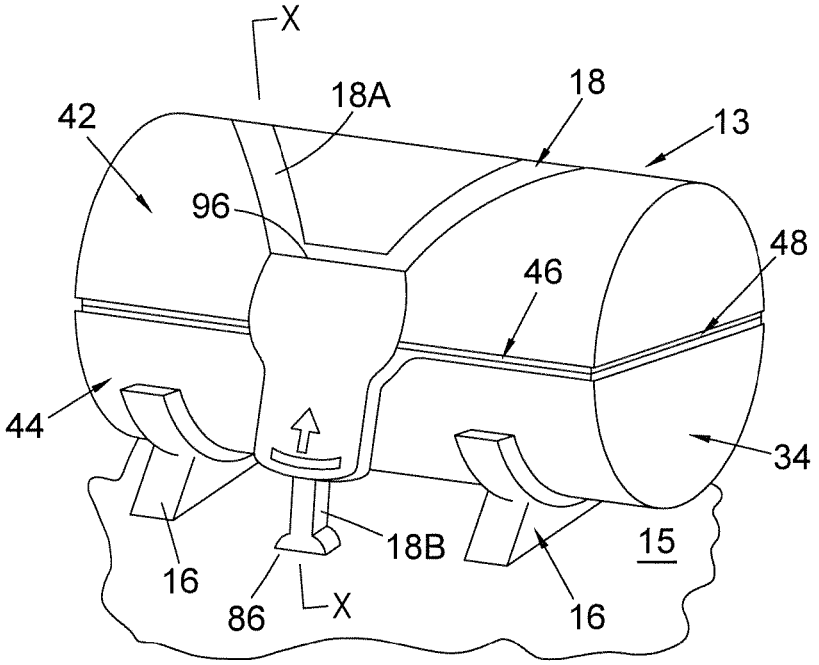
FIG. 6 shows a front perspective view of a liferaft system in accordance with an embodiment of the invention showing an example configuration of the flaps and a mounting system.

As discussed in relation to the prior art, the container is mounted on the deck 15 of a vessel by a cradle 16 (see FIGS. 6 and 7). A strap or straps 18 are fixed at the rear end to either the cradle 16 or the deck 15 of the vessel at the rear end and are attached to the deck 15 of the ship at the front of the liferaft system by a mounting 86. In the embodiment, the straps 18 extend over the sheet of the material 36 which overlies the container 10.

The liferaft deployment apparatus 88 allows the strap or straps 18 to be released manually or automatically, so that the liferaft 11 can be deployed when required.

The deployment apparatus 88 may be provided between a main portion 18A of the strap 18 and a front mounting portion 18B of the strap 18—where the strap 18 extends over the front of the liferaft system.

A manual release (e.g. a senhouse slip) 90 allows the strap 18 to be released manually by a crew member, if desired.

To allow automatic release of the strap 18, the liferaft deployment apparatus 88 includes a first hydrostatic release unit 92 that is automatically activated when submerged below the surface of the water, e.g. by between, 1.5 m and 4 m, and which releases a knife which cuts a rope that connects the main portion 18A of the strap 18 to the front mounting portion 18B of the strap 18—thereby separating the main portion 18A of the strap 18 from the front mounting portion 18B of the strap 18 connected to the deck 15 by the mounting 86, and thereby releasing the liferaft system from the vessel and freeing the half shells 12, 14 to open apart when required to facilitate deployment of the liferaft.

A second hydrostatic release unit 94 may be provided for severing the electrical supply cable 60, which is connected to the vessel at one end and to the sheet of material 36 at the other end. The second hydrostatic release unit 94 may be automatically activated when submerged below the surface of the water, e.g. by between, 1.5 m and 4 m. It should be understood that a single hydrostatic release unit could be used to release both the strap 18 and the electrical supply cable 60.

As an alternative to the second hydrostatic release unit 94 for severing the electrical supply cable 60, the electrical supply cable 60 may a plug and socket connector that automatically releases when subject to a predetermined pulling force.

A painter line may be provided in a conventional way for triggering inflation of the liferaft 11.

It will be understood by those skilled in the art that the deployment apparatus 88 is important for the correct operation of the liferaft 11. Advantageously, according to the embodiment of the invention, the flap 72 that extends from the second region 44 extends behind the deployment apparatus 88 and the flap 70 that extends from the first region 42 extends in front of the deployment apparatus 88. When the flap 70 is in the closed position, as shown in FIG. 8A, the deployment apparatus 88 is heated (or insulated) and so it is protected from the ambient temperature. This is advantageous compared to providing a separate heated hydrostatic release arrangement.

The flap 70 may include an opening or openings 96 (FIGS. 6 and 8A) at its proximal end in order to allow the strap 18 to pass therethrough so that the portion of the strap that includes the deployment apparatus 88 is positioned between the flaps 70 and 72.

Figure 9:
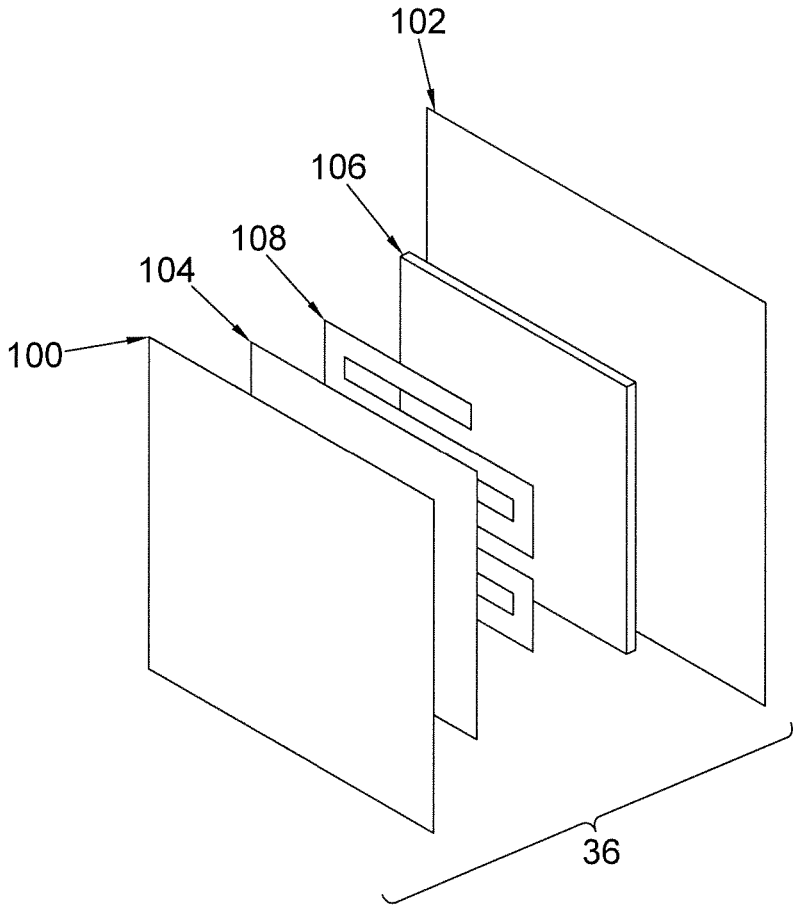
FIG. 9 shows an exploded view of the layers forming the sheet of material of the warming jacket.

FIG. 9 shows one example of the configuration of the sheet of material 36. The material may include an inner vinyl envelope 100 and an outer vinyl envelope 102, each formed of flame retardant vinyl polyester scrim (to provide strength and tear resistance). A heat spreader sheet 104, formed of graphite composite, is provided adjacent to the inner vinyl envelope 100. An insulation layer 106, formed of flame retardant foam, is provided adjacent to the outer vinyl envelope 102. Between the insulation layer 106 and the heat spreader sheet 104 is provided a resistance heating wire 108 in a tape package layer that is supplied by the electrical cable 60.

However, it should be understood that this is just one example of the configuration of the sheet of material 36, and other configurations and compositions of the sheet of material 36 are possible, that allow heating to be applied to the container 10. For example, the electrical heating may be produced by knitted carbon fibres embedded in a sheet of material.

The sheet of material 36 may extend over the deployment apparatus 88, including the hydrostatic release units 92 and 94, by overlying the deployment apparatus 88. In such an arrangement no separate flaps are required.

Although in the embodiment illustrated, a flap 70 of the sheet of material 36 extends over the deployment apparatus 88, including the hydrostatic release units 92 and 94, in an alternative embodiment, the sheet of material 36 may extend just around the container 10, with the deployment apparatus 88 being external. In a further alternative embodiment, the sheet of material 36 may extend over the cradle as well as over the container 10 (and optionally the deployment apparatus 88).

The warming jacket 13, comprising the sheet of material 36, the end walls 32 and 34 and, optionally, the flaps 70 and 72 may be retrofitted to liferaft containers already in use on vessels without requiring any significant modifications to those liferaft containers.

The level of insulation provided between the heating wire layer 108 and the outer vinyl envelope 102 (primarily by the insulation layer 106) is advantageously selected so that a desired proportion of the heat generated by the heat wire layer 108 is directed inwardly, to the interior volume of the container 10, and a desired proportion is directed outwardly, to heat the exterior surface of the sheet of material 36. The proportion of the heat directed to the exterior of the sheet 36 is advantageously sufficient to prevent substantial build-up of ice over the sheet of material 36.

As mentioned above, known liferaft containers on vessels operating in low temperature environments may accumulate a layer of ice. The layer of ice, if sufficiently thick, can stop the container from opening (and also the automatically releaseable coupling may not operate due to the ice build-up).

According the embodiment, the proportion of the heat directed to the exterior of the sheet 36 is advantageously sufficient to prevent, for example, a build-up of ice having a depth of greater than 10 mm. By keeping the ice build-up at or below 10 mm, this will allow the container to open without undue difficulty.

The amount of heat applied to outside of the sheet of material 36 may be controlled in a different manner, and not just by the design of the insulation layer 106. The amount of heat applied to outside of the sheet of material 36 may be controlled by an auxiliary heater layer at or near the exterior of the sheet of material 36. A combination of the design of the insulation layer 106 and an auxiliary heater layer at or near the exterior of the sheet of material 36 may be used.

The arrangements described above are examples that allow a desired proportion of the heat generated by the heat wire layer 108 is directed inwardly, to the interior volume of the container 10, and a desired proportion of heat directed outwardly, to heat the exterior surface of the sheet of material 36. Other arrangements may also be provided.

The heating of the sheet of material 36 is preferably controlled by a power control system that controls the power supplied to the electrical cable 60, and thus the heating applied to the liferaft 11. The power control system includes an ambient temperature indicative sensor that is preferably located at one of the end walls 32 and 34 (and therefore away from the direct influence of any heat generated by the sheet of material 36, if the end walls 32 and 34 are not directly heated). A heating effect sensor is also provided. This can be located between the sheet of material 36 and the container 10 or inside the container 10 (or both).

The power control system receives signals from ambient temperature indicative sensor and the heating effect sensor. When the ambient temperature indicative sensor detects an ambient temperature of between +5° C. and +8° C. the power control system activates the heating wire layer 108 by applying power thereto from the cable 60 so as to heat the liferaft 11. However, the heating effect sensors are also monitored to provide an indication of the temperature inside the container 10. If the temperature exceeds a maximum threshold, which might—for example—damage the liferaft 11, the power control system deactivates (or reduces the power supplied to) the heating wire layer 108 by cutting (or reducing) the power supplied by the cable 60—until the temperature inside the container 10 reduces to a selected value. Such a power control system allows other heating effects to be taken into account such as caused by direct sunlight.

A display may be provided that is associated with each of the warming jackets 13 that includes an indicator that indicates that heating is occurring. The display is controlled by the power control system. Advantageously, the power control system includes a timer that records the time period from when the power control system was activated, and provides in the display a warning indicator that is active until the power control system has been operational for a predetermined minimum period. Until this minimum period has passed, the vessel should not sail. The predetermined minimum period is selected so that there is sufficient time to allow a liferaft system, that may have been kept in very cold conditions (without the power control system activated, such as when stored off the vessel), to heat the liferaft 11 to a safe operating temperature.

The power control system and the heating wire layer 108 may be powered by an electricity source on the vessel.

Each of the end walls 32 and 34 may be provided with a heating material of the same form of the sheet of material 13, and which may be controlled by the power control system (or may be independently controlled).

Although the embodiment has been described in relation to an inflatable liferaft, it should be understood that the invention is also applicable to liferafts of other types. The invention may enable the regulation of the temperature of any type of liferaft that is stored in a container.

What is claimed is:

1. A liferaft container heater comprising at least one sheet of material for fitting over an exterior surface of the liferaft container and configured to heat an interior volume of the liferaft container, wherein the sheet of material comprises first and second regions for fitting over respective first and second relatively moveable portions of the liferaft container, and wherein the first region is attached to the second region by an automatically releaseable coupling.

2. The liferaft container heater of claim 1, wherein the releaseable coupling comprises a portion of the sheet of material with a line of weakness.

3. The liferaft container heater of claim 2, wherein the line of weakness comprises a perforated area of the sheet of material.

4. The liferaft container heater of claim 1, including a flap extending from the sheet of material for covering liferaft deployment apparatus.

5. The liferaft container heater of claim 4, wherein the flap is thermally insulated and/or heated.

6. The liferaft container heater of claim 1, wherein the sheet of material is shaped to fit around at least a portion of the liferaft container.

7. The liferaft container heater of claim 1, wherein the sheet of material includes an electrically powered heater.

8. The liferaft container heater of claim 1, wherein the sheet of material is configured to heat an exterior surface thereof.

9. A liferaft system comprising a container for storing a liferaft, and at least one sheet of material for fitting over an exterior surface of the liferaft container and configured to heat an interior volume of the liferaft container, wherein the container includes first and second relatively moveable portions configured to allow the container to open to facilitate removal of contents of the container, and wherein the sheet of material comprises first and second regions located respectively over the first and second relatively moveable portions of the liferaft container, wherein the first region is attached to the second region by an automatically releaseable coupling.

10. The liferaft system of claim of claim 9, wherein the first region meets the second region at a position that is aligned with a position where the first and second relatively moveable portions meet.

11. The liferaft system of claim 9, wherein the releaseable coupling is positioned one end of the first region, and another end of the first region is joined continuously to the second region.

12. The liferaft system of claim 9, including liferaft deployment apparatus, and wherein the sheet of material is operable to heat the deployment apparatus, the sheet of material optionally including a flap extending from the sheet of material for covering the liferaft deployment apparatus.

13. The liferaft system of claim 9, wherein the liferaft container is generally cylindrical, and wherein the first and second relatively moveable portions are generally semi-cylindrical.

14. The liferaft container of claim 1, wherein the releasable coupling comprises at least one of a burst-open zipper, a hook-and-loop type fastener, and press studs.

15. A method of facilitating heating of an interior volume of the liferaft container for storing a liferaft, wherein the container includes first and second relatively moveable portions configured to allow the container to open to facilitate removal of contents of the container, the method including fitting at least one sheet of material that is configured to heat an interior volume of the liferaft container over an exterior surface of the liferaft container, the sheet of material comprising first and second regions which are located respectively over the first and second relatively moveable portions of the liferaft container, including attaching the first region to the second region by an automatically releaseable coupling.

16. The method of claim 15, wherein the releasable coupling comprises at least one of a burst-open zipper, a hook-and-loop type fastener, and press studs.

17. The method of claim 15, wherein the automatically releaseable coupling comprises a portion of the sheet of material with a line of weakness.

18. The method of claim 15, wherein the first region meets the second region at a position that is aligned with a position where the first and second relatively moveable portions meet.

* * * * *